US005331288A

United States Patent [19]

Darrow

[11] Patent Number: 5,331,288

[45] Date of Patent: Jul. 19, 1994

[54] RAILROAD RAIL SIGNAL RECEIVER HAVING FREQUENCY CONVERSION AND A RESONANT TUNED TRANSFORMER SECONDARY

[75] Inventor: John O. G. Darrow, Murrysville, Pa.

[73] Assignee: Union Switch & Signal Inc., Pittsburgh, Pa.

[21] Appl. No.: 673,025

[22] Filed: Mar. 21, 1991

[51] Int. Cl.[5] ..... H03B 19/00; H03K 5/00; B61L 21/00; G01R 25/00

[52] U.S. Cl. ..... 328/13; 328/15; 328/28; 307/261; 307/282; 246/34 R; 324/87

[58] Field of Search ..... 246/34 R, 34 B, 34 CT, 246/40, 41, 122 R, 128, 130; 328/16, 13, 15, 28; 307/514, 571, 573, 576, 585, 261, 282, 270; 324/87

[56] References Cited

U.S. PATENT DOCUMENTS

| | | | |
|---|---|---|---|
| 1,975,371 | 10/1934 | Place | 179/171 |
| 2,019,166 | 10/1935 | Whitelock | 246/3 |
| 2,029,396 | 2/1936 | Sorensen | 179/82 |
| 2,032,725 | 3/1936 | Sorensen | 246/63 |
| 2,129,313 | 9/1938 | Whitelock | 179/171 |
| 2,534,746 | 12/1950 | Wells | 177/353 |
| 2,828,363 | 3/1958 | Ray | 179/2.5 |
| 2,947,814 | 8/1960 | Haner, Jr. | 178/66 |
| 3,021,506 | 2/1962 | Haner et al. | 340/147 |
| 3,634,728 | 1/1972 | Moury | 317/16 |
| 3,639,819 | 2/1972 | Wiart | 318/138 |
| 3,946,972 | 3/1976 | Grundy | 246/34 CT |
| 4,298,179 | 11/1981 | Gilcher | 307/514 |
| 4,392,626 | 7/1983 | Pascoe | 246/34 R |
| 4,535,959 | 8/1985 | Gilcher | 246/34 R |

OTHER PUBLICATIONS

Phillips, Jr., "Railroad Operation and Railway Signaling", Simmon-Broadman Publishing Corporation, Chicago 1942, pp. 36–37.

*Primary Examiner*—Timothy P. Callahan
*Assistant Examiner*—Trong Phan
*Attorney, Agent, or Firm*—Buchanan Ingersoll

[57] ABSTRACT

A receiver for use in receipt of signals on railroad rails which converts the rail signal to a higher frequency and feeds the higher frequency signal into an input transformer. The secondary of the input transformer is in a tuned circuit which is resonate at the higher frequency and which contains a winding of an output transformer. The tuned circuit can be tuned to the higher frequency by series components such as a resistor and capacitor.

25 Claims, 1 Drawing Sheet

RAILROAD RAIL SIGNAL RECEIVER HAVING FREQUENCY CONVERSION AND A RESONANT TUNED TRANSFORMER SECONDARY

BACKGROUND OF THE INVENTION

1. Field of the Invention

This invention relates to a vital apparatus for receiving signals transmitted over railroad rails. It is more particularly concerned with vital receivers having low impedance for such purpose.

2. Description of Prior Art

Communication over railroad rails using electrical signals had been accomplished using direct current, coded direct current or alternating current. Receivers to detect or decode such signals may be located on locomotives, transit vehicles, or wayside, wherever it is desired to interface with such rail signals. Steady state direct current permits transmission of only one piece of information; coded DC or AC can accommodate many specific communications. Where communication over distances as great as several miles is desired, the high and variable losses in rail transmission lines requires signals of very low frequencies such as 2 to 10 Hertz. It is fairly often desired to use track receivers in track circuits where the loss of detection of such signals is an indication that either the track is occupied or that the rail is broken. Because of variations and transmission losses in rail-to-rail impedance caused by ballast conditions, it is necessary to use a receiving device of extremely low impedance, usually under 1 ohm. It is essential for safety considerations that detection be free from ambiguity; therefore, the input impedance of the receiver must not, as the result of any component failure, have an increased input impedance without a corresponding loss in sensitivity. A conventional receiver with input shunted by a resistor would be unsafe if the resistor or its wiring should open because its input impedance would increase and the receiver sensitivity would also increase.

SUMMARY OF THE INVENTION

This invention provides a vital receiver by using a frequency converter to change the signal from the rail to a higher frequency alternating signal. In the case of DC this frequency converter can be a solid state chopper device which will convert either DC or pulsed DC into a higher frequency alternating polarity pulsed signal. Similarly AC track signals can be converted to a higher frequency signal using similar solid state frequency conversion circuitry. This converted higher frequency signal is then fed to an input transformer. The output of the transformer is fed into a tuned circuit. The tuned circuit uses the input transformer's secondary along with discrete components and the primary winding inductance of an output transformer to form a tuned circuit that has as its resonant frequency the same higher frequency which has previously been converted. In addition to acting as part of the resonant circuitry, the input transformer provides impedance matching to the desired low impedance seen from the rails. The resonant circuit components can be selected from resistances, capacitance, or inductance as required to meet the specific impedance and frequencies of a given circuit. One of the components in the resonant circuit includes the primary of an output transformer. The output transformer provides isolation and impedance matching between the high frequency signal in the resonant circuitry and the output. The output from the secondary of the output transformer can be used to sense the track signal. Because of the series arrangement of components and the necessity to match impedance, failures in the receiver which raise the impedance presented to the rails will also cause a corresponding decrease in the signal at the output.

DESCRIPTION OF EMBODIMENTS

Figure 1:
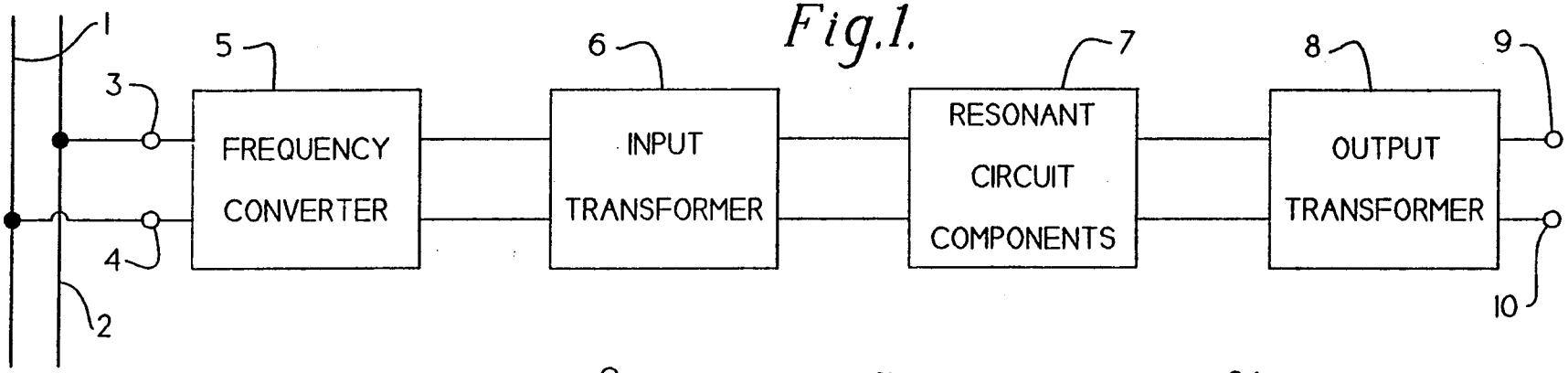
FIG. 1 is a block diagram of one presently preferred embodiment of the invention.

Referring to FIG. 1 is shown a set of rails 1 and 2 which have superimposed thereon the signal which it is desired to receive. The signal is brought to terminals 3 and 4 of a frequency converter device 5. While the FIG. 1 circuit shows a direct connection, other known means of delivering the signal to the receiver can be used. In addition, while no transformer is shown coupling the rails to terminals 3 and 4, it is understood that in some embodiments this will be a preferred method to deliver a signal to the receiver. The track signal available to terminals 3 and 4 is then converted into a higher frequency bipolar signal by a frequency converter 5. If the track signals were DC or coded DC, having a typical low frequency less than 10 Hertz then the frequency converter in the presently preferred embodiments could be an inverting DC chopper device having an output frequency greater than a thousand Hertz and in some embodiments outputs from DC choppers having a frequency of the order of magnitude of 10K Hertz have been contemplated. The output frequency chosen will depend upon the component design requirements for a specific installation. The high frequency output of the converter 5 is then fed to an input transformer 6. Between the input transformer 6 and the output transformer 8 are resonant circuit components 7 which are selected to provide the resonant frequency in the secondary of the input transformer 6, including the inductances and resistances in both input and output transformers 6 and 8 to resonate at the fixed frequency as converted by the frequency converter 5. The secondary of the output transformer 8 is then delivered to the receiver output terminals 9 and 10. In the case where the rails signal has been a pulsed DC coded signal and the frequency converter 5 has been an inverting DC chopper, then if the output at terminals 9 and 10 are fed to a full wave rectifying bridge circuit, the result will be a reconstruction of the original track circuit without the converted higher frequency present.

Figure 2:
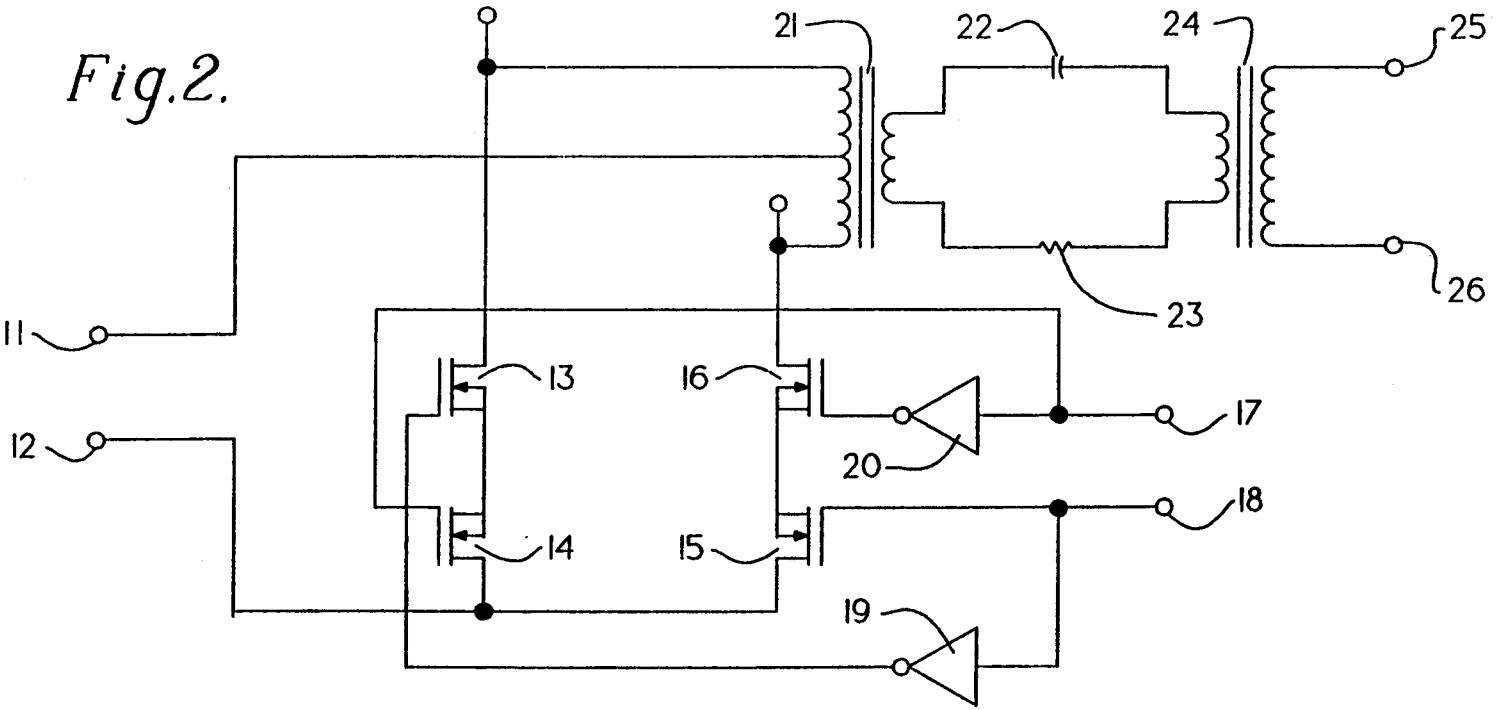
FIG. 2 is a circuit diagram of a presently preferred embodiment of the invention using solid state switching, and a series resistor and capacitor as resonant circuit components.

Further details of the circuitry and the components are shown in FIG. 2. The rail signal is delivered to input terminals 11 and 12. For an analysis of the circuit of FIG. 2 it will be assumed that the input signal from the track is a coded DC signal having a frequency of approximately 5 Hertz. This low frequency pulsed DC signal is then converted into a higher frequency alternating signal by means of a solid state inverting chopper using solid state switching elements 13, 14, 15, and 16. A gating signal of the desired high frequency is applied to terminals 17 and 18. Such a signal typically could be 10K Hertz. The solid state switches 13, 14, 15, and 16, field effect transistors in presently preferred embodiments, are gated by appropriate signals and phase relationship from inverters 19 and 20. The output of this bridge circuit then feeds the primary winding of input transformer 21, in a center tap arrangement. In presently preferred embodiments it is desirable to use field effect transistors devices for chopping switches 13, 14, 15, and 16 which are available with "on" resistances of only a few hundredths of an ohm. Because these devices have an inherent built-in reverse diode from drain to source, if an AC signal is to be chopped, they must be used in series pairs, back-to-back. Other frequency converting circuits or chopping devices can be used to practice this invention. In addition while a center tap transformer 21 is used with the input transformer 21, other transformer arrangements are equally applicable. Input transformer 21 acts to reflect the load impedance of the secondary circuit as seen by the rails by the square of the turns ratio. The impedance in the secondary circuit of the input transformer 21 includes the series arrangement of resistor 23, capacitor 22, and the respective impedance of the windings of transformers 21 and 24. The load presented to the input terminals 11, 12 is primarily determined by the turns ratio of input transformer 21 and the value of the impedance in the secondary of input transformer 21. Resistor 23 can be selected to be the primary determining factor of the secondary impedance so that the impedance can be accurately controlled. Resistor 23 can have a high value relative to the other series impedance in the secondary of input transformer 21. Since the signal from the track circuit will normally be reconstructed at the terminals 25, 26 of the receiver, it is desirable to have transformers 21 and 24 act as linearly as possible.

As can be seen in FIG. 2 any failure which would increase the impedance presented to the rails, at terminals 11, 12, such as an increase in resistance of the resistor 23, or an open or short of the capacitor 22, would cause a corresponding change in the output, secondary, of transformer 24. Changes in value of capacitor 22 causes the circuit to be out of tune and result in a reduction of signal delivered to terminals 25, 26. The impedance of the resonant circuit including the series impedance of capacitor 22, resistor 23, and the respective windings of transformers 21 and 24 cannot rise without a decrease in the output signal across terminals 25 and 26. Similarly, failures of components on the input side of transformer 21 such as switch devices 13, 14, 15, 16, causes a reduction in the signal strength or frequency to transformer 21, which in turn results in a reduced output at terminals 25 and 26.

While the above embodiment has been described with regard to a rail signal that is preferably coded DC, the invention is also practiced with AC rail signals. The frequency converter merely changes the AC signal into a predetermined higher frequency. The output can either be used at the higher frequency or converted back to the lower rail frequency.

While certain embodiments of the invention have been described herein, it is to be understood that other practices of the invention are included within the scope of the following claims.

I claim:

1. A receiver for reception of signals transmitted on railroad rails comprising:

frequency converter means for converting the frequency of said signal into a higher frequency signal;

an input transformer having a primary winding electrically connected to said frequency converter means to conduct said higher frequency signal in said primary winding;

the secondary winding of said input transformer connected as an active circuit element of a resonant circuit having a resonant frequency generally equal to the frequency of said higher frequency signal; and an output transformer having a first winding and a second winding, said first winding being an active circuit element in said resonant circuit and said second winding mechanically coupled to said first winding to provide an output signal corresponding to said higher frequency signal.

2. The receiver of claim 1 wherein said resonant circuit further includes at least one circuit component in series with said secondary winding of said input transformer and said first winding of said output transformer.

3. The receiver of claim 2 wherein said circuit component comprises a capacitor.

4. The receiver of claim 3 wherein said circuit component further comprises a resistor.

5. The receiver of claim 2 wherein said circuit component further comprises a resistor.

6. The receiver of claim 1 wherein said frequency converter means includes solid state switching means for switching said signal at said higher frequency.

7. The receiver of claim 6 wherein said solid state switching means alternates the polarity of said signal at said higher frequency.

8. The receiver of claim 6 wherein said resonant circuit further includes at least one circuit component in series with said secondary winding of said input transformer and said first winding of said output transformer.

9. The receiver of claim 8 wherein said circuit component further comprises a resistor.

10. The receiver of claim 8 wherein said circuit component comprises a capacitor.

11. The receiver of claim 7 wherein said resonant circuit further includes at least one circuit component in series with said secondary winding of said input transformer and said first winding of said output transformer.

12. The receiver of claim 11 wherein said resonant circuit further comprises a resistor.

13. The receiver of claim 12 wherein said circuit component comprises a capacitor.

14. The receiver of claim 1 wherein said signal is a coded DC signal;

said frequency converter means includes solid state switching means for switching said signal at said higher frequency; and said solid state switching means alternates the polarity of said signal at said higher frequency.

15. The receiver of claim 14 wherein said resonant circuit further comprises a series resistor.

16. The receiver of claim 15 wherein said resonant circuit further includes at least one circuit component in series with said secondary winding of said input transformer and said first winding of said output transformer; and said circuit component comprises a capacitor.

17. The receiver of claim 14 wherein said resonant circuit further includes at least one circuit component in series with said secondary winding of said input transformer and said first winding of said output transformer; and circuit component comprises a capacitor.

18. The receiver of claim 14 wherein said coded DC signal has a frequency of generally less than 10 Hertz.

19. The receiver of claim 14 wherein said higher frequency is generally in the range from 5K Hertz to 50K Hertz.

20. The receiver of claim 18 wherein said higher frequency is generally in the range from 5K Hertz to 50K Hertz.

21. A receiver for reception of signals transmitted on railroad rails comprising:

frequency converter means for converting the frequency of said signal into a higher frequency signal;

an input transformer having a primary winding electrically connected to said frequency converter means to conduct said higher frequency signal in said primary winding;

the secondary winding of said input transformer connected as an active circuit element on a resonant circuit having a resonant frequency generally equal to the frequency of said higher frequency signal;

an output transformer having a first winding and a second winding, said first winding being an active circuit element in said resonant circuit and said second winding magnetically coupled to said first winding to provide an output signal corresponding to said higher frequency signal;

said frequency converter means includes solid state switching means for switching said signal at said higher frequency;

said solid state switching means alternates the polarity of said signal at said higher frequency; and said solid state switching means includes two pairs of field effect transistors connected in a chopper circuit, each pair having one of said transistors having a gate controlled by a switching signal and the other of said transistors having a gate controlled by said switching signal through an inverter.

22. The receiver of claim 7 wherein said resonant circuit further comprises at least one circuit component in series with said secondary winding of said input transformer and said first winding of said output transformer.

23. The receiver of claim 22 wherein said circuit component includes a resistor and capacitor.

24. The receiver of claim 23 wherein said signal is a coded DC signal having a frequency of generally less than 10 Hertz.

25. The receiver of claim 24 wherein said higher frequency is generally in the range from 5K Hertz to 50K Hertz.

* * * * *